US010373450B2

(12) United States Patent
Mandlakazi

(10) Patent No.: US 10,373,450 B2
(45) Date of Patent: Aug. 6, 2019

(54) ALERT DEVICE, SYSTEM AND METHOD

(71) Applicant: Zuko Mandlakazi, Gauteng (ZA)

(72) Inventor: Zuko Mandlakazi, Gauteng (ZA)

( * ) Notice: Subject to any disclaimer, the term of this patent is extended or adjusted under 35 U.S.C. 154(b) by 0 days.

(21) Appl. No.: 15/738,245

(22) PCT Filed: Jun. 23, 2016

(86) PCT No.: PCT/ZA2016/000014
§ 371 (c)(1),
(2) Date: Dec. 20, 2017

(87) PCT Pub. No.: WO2016/210453
PCT Pub. Date: Dec. 29, 2016

(65) Prior Publication Data

US 2018/0190084 A1 Jul. 5, 2018

(30) Foreign Application Priority Data

Jun. 26, 2015 (ZA) ..... 20145/04641

(51) Int. Cl.
*G08B 23/00* (2006.01)
*G08B 5/36* (2006.01)
(Continued)

(52) U.S. Cl.
CPC ..... *G08B 5/36* (2013.01); *A44C 5/0015* (2013.01); *G08B 1/08* (2013.01); *G08B 7/06* (2013.01);
(Continued)

(58) Field of Classification Search
CPC ..... G08B 5/36; G08B 21/02; G08B 25/10; G08B 1/08; G08B 7/06; G08B 21/0227; G08B 21/24; G08B 25/10; A44C 5/0015
(Continued)

(56) References Cited

U.S. PATENT DOCUMENTS 5,450,060 A * 9/1995 Parkhurst ..... G08B 13/19 340/286.11
7,139,222 B1 * 11/2006 Baxter ..... G01S 5/18 367/127
(Continued)

FOREIGN PATENT DOCUMENTS

WO 2006078401 7/2006
WO 2014168594 10/2014

OTHER PUBLICATIONS

International Search Report for PCT/ZA2016/000014, Completed by the Austrian Patent Office dated Sep. 28, 2016, 5 Pages.

*Primary Examiner* — Zhen Y Wu
(74) *Attorney, Agent, or Firm* — Brooks Kushman P.C.

(57) ABSTRACT

Alert device, system and method for alerting hearing-impaired persons through a sensory of a sound and the location of such sound. The device extends to the tracking of an object within a predefined perimeter, outside of which an alert is triggerable. The device includes a wearable unit having a plurality of differently colored LEDs and a plurality of differently colored sound-detecting units, with each of the differently colored sound-detecting units corresponding to the same colored LED's on the wearable unit thereby to color code the wearable unit to the sound-detecting units. When a sound is detected by one or more of the sound-detecting units being higher than a predetermined threshold sound, a sound event signal is triggered on the wearable unit activating a vibration and blinking of the LED's corresponding with the respective sound detecting unit, consequentially alerting a user of the location where the sound-detecting unit was previously positioned.

16 Claims, 4 Drawing Sheets

(51) Int. Cl.

| | |
|---|---|
| ***A44C 5/00*** | (2006.01) |
| ***G08B 1/08*** | (2006.01) |
| ***G08B 7/06*** | (2006.01) |
| *G08B 21/02* | (2006.01) |
| *G08B 25/10* | (2006.01) |
| *G08B 21/24* | (2006.01) |

(52) U.S. Cl.
CPC ..... *G08B 21/02* (2013.01); *G08B 21/0227* (2013.01); *G08B 21/24* (2013.01); *G08B 25/10* (2013.01)

(58) Field of Classification Search
USPC ..... 340/500
See application file for complete search history.

(56) References Cited

U.S. PATENT DOCUMENTS 9,443,410 B1* 9/2016 Constien ..... G08B 21/0453
9,747,770 B1* 8/2017 Bartlett ..... G08B 21/0269
2002/0005783 A1* 1/2002 Irizarry ..... G08B 13/2408 340/572.1
2005/0237208 A1* 10/2005 Wojcik ..... A01M 31/002 340/573.2
2006/0167687 A1* 7/2006 Kates ..... G09B 21/00 704/235
2006/0219783 A1* 10/2006 Willis ..... G06Q 50/20 235/385
2008/0165047 A1* 7/2008 Fisher ..... F41A 17/06 342/45
2010/0246328 A1* 9/2010 Gudgel ..... G01S 3/8083 367/127
2011/0156898 A1* 6/2011 Taillefer ..... G08B 1/08 340/539.11
2012/0086557 A1* 4/2012 Inatomi ..... H04W 12/02 340/10.3
2014/0313040 A1* 10/2014 Wright, Sr. ..... G08B 17/10 340/628
2015/0035672 A1* 2/2015 Housley ..... G08B 21/0275 340/539.13
2015/0109126 A1* 4/2015 Crawford ..... G08B 21/0269 340/539.13
2015/0187197 A1* 7/2015 Golomb ..... G08B 21/0205 340/686.1
2016/0042629 A1* 2/2016 Snyder ..... G08B 21/088 340/573.6
2016/0155314 A1* 6/2016 Snyder ..... G08B 21/084 340/573.6
2016/0352574 A1* 12/2016 Cudak ..... H04L 41/0886
2017/0018248 A1* 1/2017 Na ..... G06F 3/14
2017/0303646 A1* 10/2017 Bricken ..... G06F 1/1652
2018/0000205 A1* 1/2018 Chinowsky ..... F21V 33/0008
2018/0137749 A1* 5/2018 Varga ..... G06F 3/011

* cited by examiner

ALERT DEVICE, SYSTEM AND METHOD

CROSS-REFERENCE TO RELATED APPLICATION

This application is the U.S. national phase of PCT Application No. PCT/ZA2016/000014 filed on Jun. 23, 2016, which claims priority to ZA Patent Application No. 2015/04641 filed on Jun. 26, 2015, the disclosures of which are incorporated in their entirety by reference herein.

BACKGROUND TO THE INVENTION

THIS invention relates to an alert device, system and method. More specifically, the invention relates to a device, system and method for alerting a hearing-impaired person through a sensory means of a sound event and the location of such sound event. The invention extends further to the tracking of an object within a predefined perimeter, outside or which an alert is triggerable.

Sensory alarm systems are well known. One such known system is disclosed in US published patent application no. 2011/0156898, which describes the combination of a plurality of sound-detecting units and a wearable unit for the hearing-impaired person, which wearable unit includes a vibrating means and a screen.

In the event of any one of the sound-detecting units detecting a sound, the vibrating means in the wearable unit is triggered to vibrate thereby to provide the hearing-impaired person with a sensory alert of such sound event. Additionally, the wearable unit displays on its screen an icon corresponding with the sound-detecting unit triggered, i.e. a fire alarm icon or a pet barking icon for respectively notifying the hearing-impaired person that the fire alarm has been tripped or that the dog is barking for its evening meal.

Although this system is capable of providing the hearing-impaired person with a sensory and visual alert of a sound event, the system has three major disadvantages. The first disadvantage is its inability to enable the hearing-impaired person to customise its use.

For example, if the user does not have a fire alarm or a pet, then the sound-detecting units and icons related to these events are rendered redundant. The second disadvantage is the cost associated with a wearable unit requiring a screen to display the respective icons.

The third disadvantage of the known system is its inability to make use of the sound-detecting units other than for detecting sound.

It is the object of the present invention to provide an alert device, system and method for addressing the disadvantages of the known prior art.

SUMMARY OF THE INVENTION

According to the invention, there is provided an alert device including a wearable unit to be operatively worn on the body of a user, wherein the wearable unit comprises:

(i) a plurality of differently coloured light sources;

(ii) a vibrator;

(iii) a means for receiving an event signal; and (iv) a rechargeable battery for powering at least the light sources, the vibration generating means and the receiver; and a plurality of sound-detecting units, wherein each of the sound-emitting units is differently coloured with a colour corresponding to the colour of the one of the coloured light sources on the wearable unit, and further wherein each of the sound-emitting units comprises:

(i) a means for detecting sound;

(ii) a means for transmitting an event signal; and (iii) a rechargeable battery for powering at least the sound detecting means and the signal transmitting means;

such that in the event of a sound detected by one or more of the sound-detecting units being higher than a predetermined threshold sound, a sound event signal is operably transmittable from such sound-detecting unit and receivable by the wearable unit thereby to activate:

(i) the vibrator to generate a vibration for alerting the user; and (ii) the coloured light source corresponding with the colour of the sound-detecting unit from which the sound event signal operably originates, so as to visually communicate the colour of such sound-detecting unit to the user and consequentially, the location at which that sound-detecting unit was previously positioned.

The wearable unit may comprise a strap or band for securing the wearable unit to the wrist of the user.

Generally, the wearable unit is water-proof or resistant.

Typically, the light sources are light emitting diodes (LED's), and the receiving means thereof is a receiver or a transceiver for wirelessly receiving and/or transmitting signals.

Preferably, the sound detecting means is a microphone, and the transmitting means thereof is a transmitter or a transceiver for wirelessly receiving and/or transmitting signals.

Each of the sound-detecting units may also include any one or more of the following:

(i) a means for tracking at least the distance between it and a base unit such that in the event that the distance is greater than a pre-set maximum, a tracking event signal is transmittable from the respective sound-detecting unit to the wearable unit, thereby to activate the vibratory alert and corresponding visual alert to the user;

(ii) a button for switching the sound-detecting unit between a sound detection mode, wherein the microphone is activated and the tracking means is deactivated, and a tracking mode, wherein the tracking means is activated and the microphone is deactivated;

(iii) a local sensitivity control for increasing and decreasing the sensitivity of the sound-detecting unit;

(iv) a processor for controlling operations of the sound-detecting unit including the transmission of sound and tracking event signals; and (v) a indicator for operably indicating that the battery is running low on power.

The base unit may be another of the sound-detecting units or the wearable unit.

Furthermore, the wearable unit may include any one or more of the following:

(i) a dismiss button for dismissing alerts, and deactivating the vibrator and the light sources;

(ii) a global sensitivity control for increasing and decreasing the sensitivity of all the sound-detecting units proportionately;

(iii) a corresponding means for tracking at least the distance between it and the respective sound-detecting unit operably switched to tracking mode;

(iv) a global tracking mode switch for switching the sound-detecting units, other than the sound-detecting unit operably switched to tracking mode, between a sound detection mode, wherein the microphones of such sound-detecting units are activated and the tracking means thereof are deactivated, and a location-monitoring mode, wherein the microphones of such sound-detecting units are deactivated and the tracking means thereof are activated to monitor the position between it and the sound-detecting unit switched to tracking mode;

(v) a processor for controlling operations of the wearable unit including the receiving of sound and tracking event signals, and activating the vibrator and lights sources in response thereto; and (vi) a indicator for operably indicating that the battery is running low on power.

The alert device may include a means for securing the sound-detecting unit operably switched to tracking mode to a person, pet or object to be tracked.

Operably with: (i) the one sound-detecting unit switched to the tracking mode; and (ii) the wearable unit switched to the location-monitoring mode; the wearable unit is generally configured to activate the coloured light source corresponding with one of the remaining sound-detecting unit positioned at that time in closest proximity to the sound-detecting unit switched to tracking mode, consequentially communicating the location of person, pet or object being tracked to the user in a visual manner.

Typically, the vibrator is permanently deactivated with the wearable unit operably switched to the location-monitoring mode.

Preferably, the receiver, transmitter or transceivers are radio frequency receivers, transmitters or transceivers.

The securing means may be a wrist strap or band having a formation sized and shaped for receiving the sound-detecting unit therein.

More preferably, the tracking means and the corresponding tracking means are first and second tracking transceivers fitted in the sound-detecting units and the wearable unit, wherein a tracking signal is transmittable by the first tracking transceiver and further wherein, and on the second transceiver receiving the tracking signal, a response tracking signal is transmittable by the second transceiver, such that the distance between the sound-detecting unit, switched to the tracking mode, and the wearable unit can operably be calculated by measuring the time lapse between the first transceiver sending and receiving the tracking and the response tracking signals respectively.

According to a second aspect of the invention, there is provided an alert system including:

a plurality of differently coloured detecting units;

a user interface via which a user can be alerted of the colour of the detecting unit having operably detected an event;

a communications module for, via a wireless communications network, communicating an event signal between the detecting units and the user interface; and one or more processors for (i) with the detecting units switched to a sound-detecting mode and on the one or more of the detecting units detecting a sound greater than a predetermined threshold sound, triggering the transmission of a sound event signal and, on receiving such sound event signal, triggering an alert on the user interface;

(ii) with one of the detecting units switched from the sound-detecting mode to a tracking mode and on the distance measured between such one detecting unit and the user interface being greater than a pre-set maximum, triggering the transmission of a tracking event signal and, on receiving such tracking event signal, triggering an alert on the user interface; and (iii) with one of the detecting units switched from the sound-detecting mode to a tracking mode and the remaining of the detecting units switched to a location-monitoring mode, triggering the transmission of a signal corresponding with the remaining detecting unit positioned at that time in closest proximity to the detecting unit switched to tracking mode, thereby to trigger an alert on the user interface.

According to a third aspect of the invention, there is provided an alert method including the steps of:

(A) positioning one of a plurality of differently coloured sound-detecting units in different locations within a predefined area;

(B) in the event of a sound detected by one or more of the sound-detecting units being higher than a predetermined threshold sound, transmitting a sound event signal from such sound-detecting unit to a wearable unit; and (C) on receipt of the sound event signal by the wearable unit, activating:

(i) a vibrator on the wearable unit to generate a vibration for alerting the user and (ii) a coloured light source on the wearable unit corresponding with the colour of the sound-detecting unit from which the sound event signal originated, so as to visually communicate the colour of such sound-detecting unit to a user wearing the wearable unit and consequentially, the location at which that sound-detecting unit was previously positioned.

According to a fourth aspect of the invention, there is provided an alert system for remotely monitoring and reporting a location of an object under surveillance to a user, in use, which system includes:

at least one first wearable device having a data processor and/or data controller, which device is configured to be worn by an object under monitoring, in use;

a second wearable monitoring device, having a data processor and/or data controller, which monitoring device is configured in communication with the wearable device and worn by the user monitoring the location of the object, in use;

the devices having transceivers arranged in electrical communication with the data processor and/or data controller;

an indicator means arranged on the second wearable monitoring device, which indicator is shaped and configured to indicate a location of object under monitoring to user, in use; and a plurality of environmental sensors arranged in wireless communication with the first wearable device wherein the sensors are shaped and configured to sense the location of the object so as to relay location attribute data wirelessly to the second wearable monitoring device for suitable processing into an indicator suitable for indicating the location of the object to the user.

For purposes of this specification, the term object shall be construed to refer to a child, adult, pet or any other mobile object suitable for monitoring.

The system may include a remote monitoring means arranged in communication with the second wearable monitoring device and environmental sensors. Accordingly location attribute data may be relayed to the remote monitoring means for suitable processing and/or processing for suitable interpretation.

The data processor and/or data controller may be configured to process data obtained wirelessly from the sensors. The transceiver may be in the form of Medium Attachment Units (MAUs) as per the institute of Electrical and Electronics Engineers (IEEE) 802.3 documents.

The indicator means may be in the form of an acoustic signal generator coupled to a visual means. Accordingly, in use, the user may be alerted of a location of the child under surveillance by a determinable gentle vibration as generated by the acoustic signal generator and a visual means in the form of a Light Emitting Diode (LED) screen may indicate a visual in relation to the location of the child, for example the colour of a wireless sensor proximal to the object may be displayed.

The user will be alerted when the child or pet breaches or goes outside the set perimeters of 100 m (one hundred metric meters). The alert happens in the form of a gentle vibration with a specific LED colour corresponding to the wireless sensor proximal to the object, for example a child or pet may under surveillance.

The visual means may be in the form of a LED light and/or lights shaped and configured to indicate the object's proximity to a particular sensor.

According to a fifth aspect of the invention, there is provided an alert method for remotely monitoring and reporting a location of an object under surveillance, which method includes the steps of:

(A) setting up a wireless network including at least one first wearable device, a second wearable monitoring device and a plurality of remote wireless sensors;

(B) sensing the location of the first wearable device by the sensors;

(C) relaying location attribute data of the first wearable device relative to the sensors to the second wearable monitoring device; and (D) processing the location attribute data means for interpretation and suitable indication and/or display on the second wearable monitoring device.

BRIEF DESCRIPTION OF THE DRAWINGS

The invention is now described, by way of non-limiting example, with reference to the accompanying drawings wherein.

DETAILED DESCRIPTION OF THE INVENTION

Figure 1:
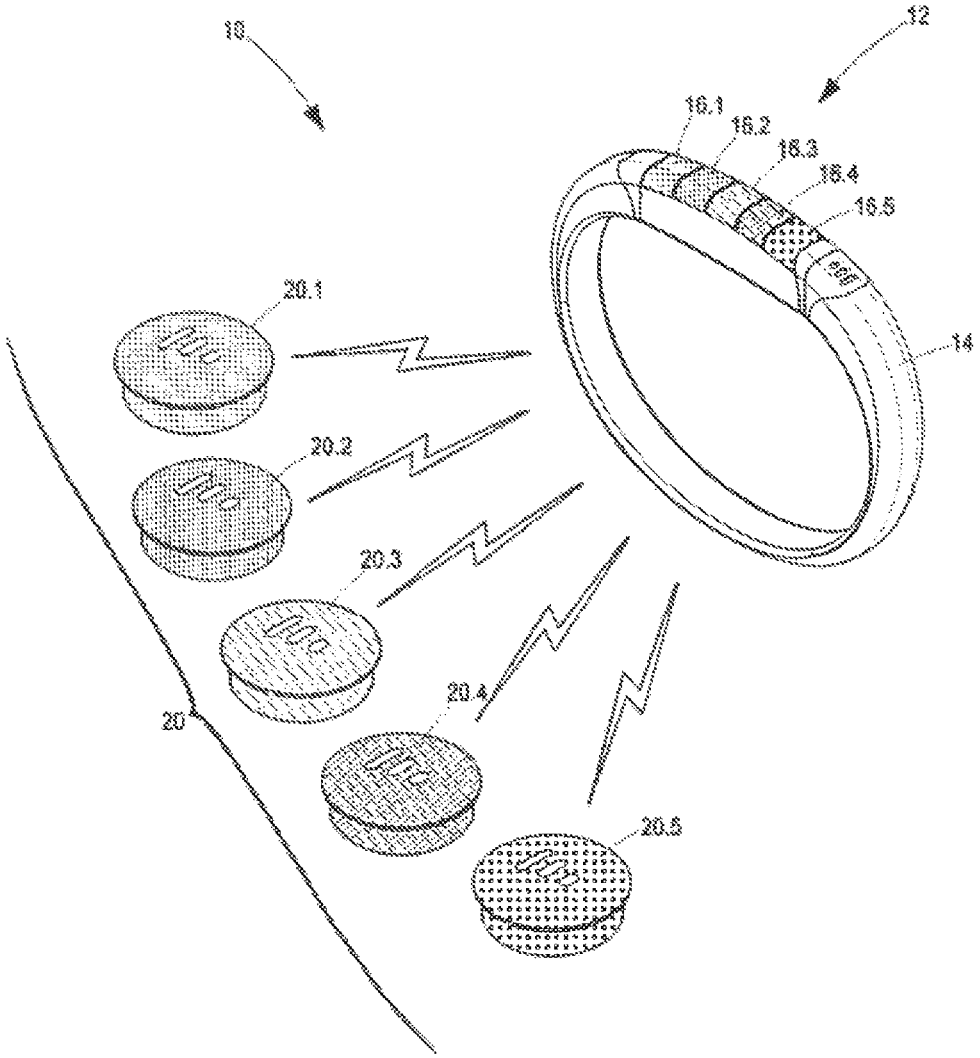
FIG. 1 shows a schematic representation of an alert device, system and method. In accordance with the invention, illustrating perspective views of a wearable unit and a plurality of sound-detecting units making up the alert device.

An alert device according to a preferred embodiment of the invention is designated generally with reference numeral 10 in FIG. 1. The alert device 10 comprises a wearable unit 12 and a plurality of sound-detecting units 20, each being coloured differently 20.1, 20.2, 20.3, 20.4, 20.5 from the other.

The wearable unit 12 comprises a strap 14 for securing it to the wrist of a user 100, typically a hearing impaired user. In its most basic form, the wearable unit 12 includes a built-in vibrator, a means for wirelessly receiving an event signal, a rechargeable battery and a plurality of light sources 16, generally in the form of light emitting diodes (LED's) each corresponding with one of the different colours of the sound-detecting units 20 thereby to colour code the wearable unit 12 and the sound-detecting units 20 to one another.

Each of the sound-detecting units 20 comprise of a means for detecting a sound (i.e. a microphone), a means for wirelessly transmitting an event signal and a rechargeable battery. It will be appreciated that the receiving and transmitting means of the respective wearable unit 12 and the sound-detecting units 20 may be a receiver, a transmitter or transceivers, more particularly radio frequency receivers, transmitters or transceivers, preferably the latter.

Figure 2:
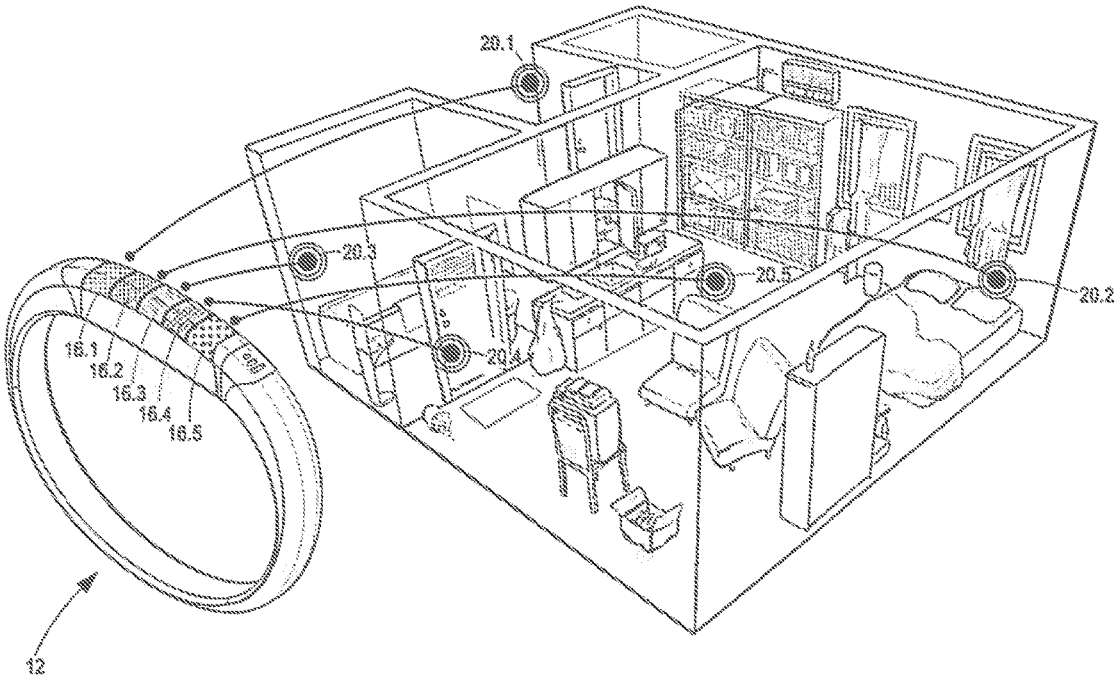
FIG. 2 shows a schematic representation of the alert device, system and method of FIG. 1 deployed in use in an environment.

In use, the user 100 positions each of the differently coloured sound-detecting units in different locations within an environment. For example, and with reference now also to FIG. 2, the environment is the user's home with the user positioning:

- a red coloured sound-detecting unit near a fire alarm siren;
- a green coloured sound-detecting unit near the front door doorbell;
- a blue coloured sound-detecting unit near the alarm clock in the bedroom;
- a yellow coloured sound-detecting unit near the back door in the kitchen; and
- a purple coloured sound-detecting unit in a secondary bedroom.

It will be appreciated that any number of different colours may be used.

With the wearable unit 12 strapped to the user's arm, and with the user having memorised the locations at which he/she positioned each of the coloured sound-detecting units, the user may proceed with his/her normal business.

The simplicity of construction of the wearable unit 12 is aimed at making the alert device 10 very cost effective to manufacture, simple to use and comfortable to wear. Preferably, the wearable unit 12 is waterproof so that the user may even bath with it on such that the wearable unit 12 need not ever be removed from the person or the user.

In the event of a sound being detected by one of the sound-detecting unit 20.4, i.e. the yellow coloured sound-detecting unit, a wireless sound event signal will be transmitted from such yellow sound-detecting unit 20.4 to the wearable unit 12.

On receipt of the sound event signal by the wearable unit 12, the built-in vibrator and the yellow LED 16.4 will be activated causing the vibrator to vibrate and the yellow LED 16.4 to shine or blink on and off.

The vibrations generated by the built-in vibrator provide the user with a sensory alert causing the user to look at the wearable unit 12. With the yellow LED 16.4 shining or blinking, the user is visually alerted to the sound-detecting unit 20.4 having detected the sound, and consequentially from memory, the location in which he/she previously positioned the yellow sound-detecting unit 20.4, i.e. in the kitchen. In this manner, the hearing impaired user is alerted of a sound having emanated from a particular location in the environment.

The description above to a large extent sets out the minimum features of a baseline alert device 10. It will be appreciated that many other components, features and functionality can be incorporated.

Each of the sound-detecting units 20 could include: a tracking means; a button for switching between a sound detection mode and a tracking mode; a predetermined threshold sound level or a local sensitivity control for increasing or decreasing the sound sensitivity of that sound-detecting unit; a processor for controlling the operations of the sound-detecting units and/or the alert device as a whole; and an indicator for operably indicating that the battery is running low on power.

In a first tracking mode, one of the sound-detecting units 20.1 is switched locally (using the button thereon) from a sound-detecting mode to a tracking mode, more particularly a first proximity tracking mode wherein a the distance between the tracking mode switched sound-detecting unit 20.1 and a base unit is monitored.

In the event of the distance between the tracking mode switched sound-detecting unit 20.1 and the base unit falling outside of a pre-set maximum, a tracking event signal is transmitted to the wearable unit 12, causing a vibration and the shining or blinking of the respective LED. It will be appreciated that the base unit may be one of the other sound-detecting units 20.2, 20.3, 20.4, 20.5 or the wearable unit 12.

Although not necessary, it is preferable that the microphone of the tracking mode switched sound-detecting unit 20.1 is deactivated when the button on such sound-detecting unit 20.1 is moved from the sound-detecting mode to the tracking mode.

To prevent the alert device 10 from alerting the user of unnecessary background or ambient noises, the sound-detecting units 20 are typically set to transmit a sound event signal only in the event of the detected sound being higher than a predetermined threshold sound. This threshold sound, i.e. the sensitivity of the sound-detecting units 20, is locally adjustable at each of the sound-detecting units 20 to take into account ambient noise being greater in one location of the environment than another.

The wearable unit 12 could include: a dismiss button for dismissing alerts; a global sensitivity control for increasing or decreasing the sound sensitivity of all of the sound-detecting units proportionately; a corresponding tracking means; a global tracking mode switch for switching the sound-detecting units between a sound detection mode and a location-monitoring mode; a processor for controlling the operations of the sound-detecting units and/or the alert device as a whole, and an indicator for operably indicating that the battery is running low on power.

It will be appreciated that more than one sound-detecting unit 20 could be tripped near simultaneously (i.e. It could happen that sound is detected by two sound-detecting units almost at the same time). Where this happens, the wearable unit 12 is configured to blink the respective coloured LED's is an alternating manner until the user has dismissed one or all of the alerts.

The global sensitivity control provides the user with the capability of increasing or decreasing the sensitivity of all of the sound-detecting units 20 proportionately from the wearable unit 12, instead of at each of the sound-detecting units spread across the environment.

In a second tracking mode, and with one of the sound-detecting units 20.1 switched locally to the tracking mode, the user may through the global tracking mode switch on the wearable unit 12 switch the remaining sound-detecting units 20.2, 20.3, 20.4, 20.5 from their normal sound-detection mode to the location-monitoring mode. In this latter mode, the microphones of such sound-detecting units are deactivated with the tracking means thereof being activated.

With the tracking means activated, the position between the tracking mode switched sound-detecting unit 20.1 and the remaining sound-detecting units 20.2, 20.3, 20.4, 20.5 are monitored thereby to cause the wearable unit 12 to activate the coloured LED corresponding with the remaining sound-detecting unit 202, 20.3, 20.4, 20.5 positioned at that time in closest proximity to the tracking mode switched sound-detecting unit 20.1, consequentialy communicating the location of such tracking mode switched sound-detecting unit 20.1 visually and in real-time.

It will be appreciated then that the tracking mode switched sound-detecting unit 20.1 is attachable to any person, pet or object thereby to track the location of such person, pet or object through the environment. It is envisaged that this functionality is best suited to tracking the location of a secondary user, i.e. a child, wherein the alert device 10 includes a securing means 30 for securing the tracking mode switched sound-detecting unit 20.1 to the wrist of such child.

Figure 3:
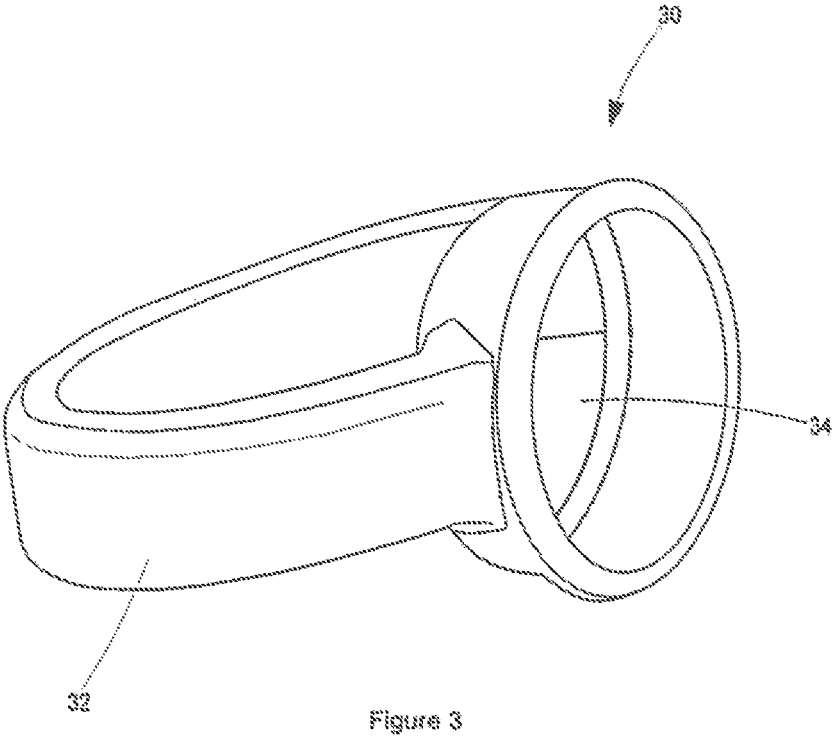
FIG. 3 shows a perspective view of a securing means for securing one of the sound-detecting units set to tracking mode to a person, pet or object.

With reference to FIG. 3, the securing means 30 is typically in the form of a wrist strap or band 32 having an annular formation 34 sized and shaped for receiving the tracking mode switched sound-detecting unit 20.1, which will have a diameter of about 25 millimeters such that it is comfortable to wear by the secondary user.

It will be appreciated that the tracking functionality of the alert device 10, as well as the system and method employed by such device 10, may be achieved in many different ways.

One way is to transmit a tracking signal from a first tracking transceiver (i.e. fitted in one of the units making up the alert device 10) and on receipt of such tracking signal by a second tracking transceiver (i.e. fitted in another of the units making up the alert device 10) sending a response tracking signal from the second tracking transceiver to the first tracking transceiver. In this manner, the distance between the first and the second tracking transceivers can be calculated by measuring the time lapse between the first transceiver sending and receiving the tracking and the response tracking signals respectively.

Figure 4:
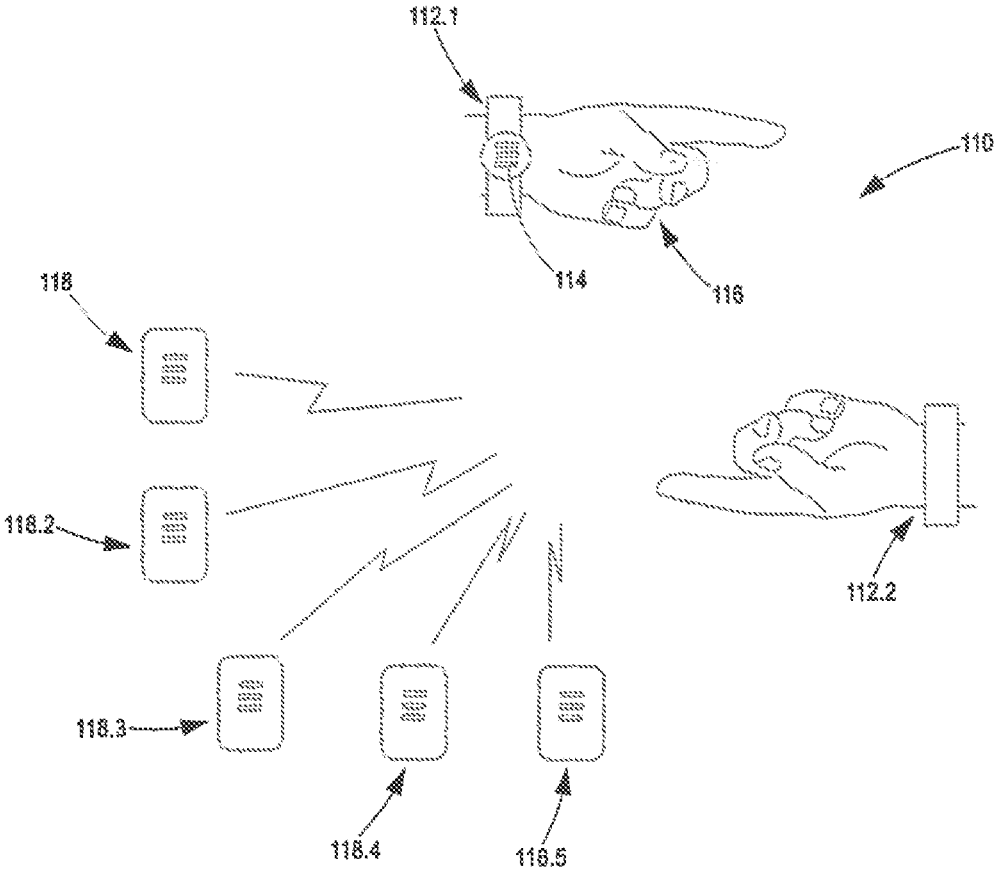
FIG. 4 shows a schematic representation of an alternative embodiment of an alert system and method in accordance with the invention.

An alternative embodiment of the invention will now be described with reference to FIG. 4, which embodiment relates to an alert system 110 for continuously monitoring and reporting environmental security parameters to relevant persons and/or security systems within a determinable environment.

The system 110 includes a wearable monitoring device 112.1 and a wearable device 112.2, worn by an object under surveillance, in this case a minor child. Each device 112.1 and 112.2 has a data processor and controller, a transceiver in the form of Medium Attachment Units (MAUs) as per the Institute of Electrical and Electronics Engineers (IEEE) 802.3 documents (not shown) arranged in electrical communication with the data processor and/or data controller, and an indicator means in the form of an LED arrangement 114 arranged on the surface of the monitoring device 112.1.

The LED arrangement 114 is shaped and configured to indicate a location of the child as per wearable device 112.2 to a user 116, in use and a plurality of environmental sensors 118.1, 118.2 118.3, 118.4 and 118.5 arranged in wireless communication with the monitoring devices 112.1 and 112.2 wherein sensors 118.1, 118.2 118.3, 118.4 and 118.5 are shaped and configured to sense the proximity and/or location of the child under surveillance 112.2 to the device 112.1 for suitable processing into the LED arrangement 114 for indicating the status of environmental attributes, for example location attribute data to the user 116.

The LED arrangement 114 is synced with an acoustic signal generator (not shown) coupled to a visual means. Accordingly, in use, the user is alerted of an environmental attribute status by a determinable gentle beep as generated by the acoustic signal generator and a Light Emitting Diode (LED) screen displays a visual in relation to a location attribute, for example, the colour of the LED may correspond to colour of the sensor 118.1, 118.2 118.3, 118.4 and 118.5 proximal to the object being monitored.

The sensors 118.1, 118.2 18.3, 118.4 and 118.5 are embedded with acoustic to signal transducers in the form of sensitive microphones (not shown). The sensors further include optical recorders in the form of embedded smart cameras (not shown) for recording images. The sensors 118.1, 118.2 118.3, 118.4 and 118.5 have inbuilt motion detectors (not shown) for detecting and/or sensing movement.

In use, a user may fasten a first wearable device 112.1 on his person and fasten the wearable device 112.2 to the minor child. On activation of the system 110, the child may begin to walk within a perimeter defined by the sensors 118.1, 118.2 118.3, 118.4 and 118.5. Smart cameras and motion detects embedded in the sensors 118.1, 118.2 118.3, 118.4 and 118.5 monitor the toddler's movement via the wearable device 112.2 and relay location data to the device 112.1 for suitable processing and display on the device 112.1.

For example, in the case where the user is monitoring the movement patterns of the minor child around a determinable perimeter, the sensors 118.1, 118.2 118.3, 118.4 on sensing that the child's wearable device 112.2 is within a proximity of danger, for example a swimming pool relays data to the device 112.1 which would process said data to generate an appropriate acoustic signal in the form of a beep and/or vibration and display an LED colour in sync with the sensor 118.1, 118.2, 118.3, 118.4 in close proximity to the child.

Furthermore, in the case of the alert system 110 being configured to monitor the toddler movements in a house, the LED arrangement 114 is configured to indicate the toddler's specific location, for example, the LED may display the toddler in predetermined unsecure environments for example, a garage, outside a determinable perimeter or within a proximity of a swimming pool.

Although only certain embodiments of the invention have been described herein, it will be understood by any person skilled in the art that other modifications, variations, and possibilities of the invention are possible. Such modifications, variations and possibilities are therefore to be considered as falling within the spirit and scope of the invention and hence forming part of the invention as herein described and/or exemplified.

For example, the alert device 10 may further include a means for translating a particular type of sound detected by the sound-detecting units into a particular vibration. Under this example, it will be appreciated that a very vigorous vibration output on the wearable unit 12 could correspond to a situation of grave danger, i.e. a fire alarm.

It shall further be understood that the examples are provided for illustrating the invention further and to assist a person skilled in the art with understanding the invention and is not meant to be construed as unduly limiting the reasonable scope of the invention.

The invention claimed is:

1. An alert device for a hearing-impaired user, the device comprising:

a wearable unit to be operatively worn on a body of the hearing-impaired user, wherein the wearable unit comprises:

(i) a plurality of differently colored light sources;

(ii) a vibrator;

(iii) a means for receiving an event signal; and (iv) a rechargeable battery for powering at least the plurality of differently colored light sources, the vibrator and the means for receiving; and a plurality of sound-detecting units which are positionable adjacent a source of sound in fixed environment, wherein each of the sound detecting units is differently colored with a color corresponding to the one of the plurality of differently colored light sources on the wearable unit, wherein each of the sound detecting units comprises:

(i) a means for detecting sound;

(ii) a means for transmitting an event signal; and (iii) a rechargeable battery for powering at least means for detecting sound and the means for transmitting;

such that in an event of a sound detected by the one or more of the sound-detecting units being higher than a predetermined threshold sound, a sound event signal is operably transmittable from such sound-detecting unit and receivable by the wearable unit thereby to activate:

(i) the vibrator to generate a vibration for alerting the hearing-impaired user; and (ii) the colored light source corresponding with the color of the sound-detecting unit from which the sound event signal operably originates, to visually communicate the color of such sound-detecting unit to the hearing-impaired user and consequentially, presents a location at which that sound-detecting unit was previously positioned.

2. The alert device according to claim 1, wherein the wearable unit comprises a strap or band for securing the wearable unit to a wrist of the user.

3. The alert device according to claim 2, wherein the wearable unit is water-proof or water resistant.

4. The alert device according to claim 2, wherein the plurality of differently colored light sources are light emitting diodes, and the receiving means thereof is a receiver or a transceiver for wirelessly receiving and/or transmitting signals.

5. The alert device according to claim 4, wherein the sound detecting means is a microphone, and the transmitting means thereof is a transmitter or a transceiver for wirelessly receiving and/or transmitting signals.

6. The alert device according to claim 5, wherein each of the plurality of sound-detecting units includes any one or more of the following:

(i) a means for tracking at least a distance between the sound-detecting unit and a base unit such that in an event that the distance is greater than a pre-set maximum, a tracking event signal is transmittable from the respective sound-detecting unit to the wearable unit, thereby to activate a vibratory alert and a corresponding visual alert to the hearing-impaired user;

(ii) a button for switching the sound-detecting unit between a sound detection mode, wherein the microphone is activated and the tracking means is deactivated, and a tracking mode, wherein the tracking means is activated and the microphone is deactivated;

(iii) a local sensitivity control for increasing and decreasing a sensitivity of the sound-detecting unit;

(iv) a processor for controlling operations of the sound-detecting unit including the transmission of sound and tracking event signals; and (v) an indicator for operably indicating that the rechargeable battery of the sound-detecting unit is running low on power.

7. The alert device according to claim 6, wherein the base unit is another one of the sound-detecting unit or wearable unit.

8. The alert device according to claim 7, wherein the wearable unit further includes any one or more of the following:

(i) a dismiss button for dismissing alerts, and deactivating the vibrator and the plurality of differently colored light sources;

(ii) a global sensitivity control for increasing and decreasing a sensitivity of all of the plurality of sound-detecting units proportionately;

(iii) a corresponding means for tracking at least a distance between the wearable unit and the respective sound-detecting unit operably switched to tracking mode;

(iv) a global tracking mode switch for switching the sound-detecting units, other than the sound-detecting unit operably switched to tracking mode, between a sound detection mode, wherein the microphones of such sound-detecting units are activated and the tracking means thereof are deactivated, and a location-monitoring mode, wherein the microphones of such sound-detecting units are deactivated and the tracking means thereof are activated to monitor the position between the wearable unit and the sound-detecting unit switched to tracking mode;

(v) a processor for controlling operations of the wearable unit including the receiving of sound and tracking event signals, and activating the vibrator and lights sources in response thereto: and (vi) an indicator for operably indicating that the rechargeable battery of the wearable unit is running low on power.

9. The alert device according to claim 8 including a means for securing the one of the plurality of sound-detecting unit operably switched to tracking mode to a person, pet or object to be tracked.

10. The alert device according to claim 9, wherein operably with:

(i) the one of the plurality of sound-detecting unit switched to the tracking mode; and (ii) the wearable unit switched to the location-monitoring mode; the wearable unit is configured to activate colored light source corresponding with one of the remaining sound-detecting unit positioned at, that time in closest proximity to the sound-detecting unit switched to tracking mode, consequentially communicating the location of person, pet or object being tracked to the hearing-impaired user in a visual manner.

11. The alert device according to claim 10, wherein the vibrator is permanently deactivated with the wearable unit operably switched to the location-monitoring mode.

12. The alert device according to claim 11, wherein the receiver, transmitter or transceiver are a radio frequency receiver, transmitter or transceiver.

13. The alert device according to claim 12, wherein the securing means is a wrist strap or band having a formation sized and shaped for receiving the sound-detecting unit therein.

14. The alert device according to claim 13, wherein the tracking means and the corresponding tracking means are first and second tracking transceivers fitted in the sound-detecting units and the wearable unit, wherein a tracking signal is transmittable by the first tracking transceiver and further wherein, and on the second transceiver receiving the tracking signal, a response tracking signal is transmittable by the second transceiver, such that the distance between the sound-detecting unit, switched to the tracking mode, and the wearable unit can operably be calculated by measuring the time lapse between the first transceiver sending and receiving the tracking and the response tracking signals respectively.

15. An alert system for a hearing-impaired user, the device comprising:

a plurality of differently colored detecting units;

a user interface via which a hearing-impaired user can be alerted of the color of the detecting unit having operably detected an event;

a communications module for, via a wireless communications network, communicating an event signal between the plurality of differently colored detecting units and the user interface; and one or more processors for:

(i) with the plurality of differently colored detecting units switched to a sound-detecting mode and the one or more of the plurality of differently colored detecting units detecting a sound greater than a predetermined threshold sound, triggering a transmission of a sound event signal and, on receiving the sound event signal, triggering a first alert on the user interface; and (ii) with one of the plurality of differently colored detecting units switched to a tracking mode and on the a distance measured between such one detecting unit and the user interface being greater than a pre-set maximum, triggering the transmission of a tracking event signal and, receiving the tracking event signal, triggering a second alert on the user interface.

16. An alert method for a hearing-impaired user, the method including the steps of:

(A) positioning one of a plurality of differently colored sound-detecting units in different locations within a predefined area;

(B) in an event of a sound detected by the one or more of the plurality of differently colored sound-detecting units being higher than a predetermined threshold sound, transmitting a sound event signal from such sound-detecting unit to a wearable unit worn by the hearing-impaired user; and (C) on receipt of the sound event signal by the wearable unit, activating:

(i) a vibrator on the wearable unit to generate a vibration for alerting the hearing-impaired user; and (ii) a colored light source on the wearable unit corresponding with the color of the plurality of differently colored sound-detecting unit from which the sound event signal originated, so as to visually communicate the colored of such sound-detecting unit to the for a hearing-impaired user wearing the wearable unit and consequentially, presents a location at which that sound-detecting unit was previously positioned.

* * * * *